US005112259A

United States Patent [19]

McElroy, Jr. et al.

[11] Patent Number: 5,112,259

[45] Date of Patent: May 12, 1992

[54] TWO PIECE DRIVE SHAFT RETENTION DEVICE FOR OUTBOARD MOTOR

[75] Inventors: Kennedy K. McElroy, Jr., Lindenhurst; Edmund H. DuBois, Zion, both of Ill.

[73] Assignee: Outboard Marine Corporation, Waukegan, Ill.

[21] Appl. No.: 373,283

[22] Filed: Jun. 29, 1989

[51] Int. Cl.[5] ..... B63H 23/34

[52] U.S. Cl. ..... 440/83; 403/359; 464/158

[58] Field of Search ..... 440/49, 83; 403/359; 464/158, 169

[56] References Cited

U.S. PATENT DOCUMENTS

| | | | |
|---|---|---|---|
| 687,676 | 11/1901 | Culver | 464/182 |
| 1,843,089 | 1/1932 | Peck | 440/76 |
| 2,384,436 | 9/1945 | Bossen | 440/58 |
| 2,466,097 | 4/1949 | Graue | 464/158 |
| 2,508,832 | 5/1950 | McAninch | 403/359 |
| 2,549,484 | 4/1951 | Kiekhaefer | 440/88 |
| 2,587,838 | 4/1952 | Green | 403/359 |
| 3,006,311 | 10/1961 | Hansson et al. | 440/75 |
| 3,025,822 | 3/1962 | Tenney | 440/75 |
| 3,069,875 | 12/1962 | Crum, Jr. | 464/169 |
| 3,212,290 | 10/1965 | Walden | 464/903 |
| 3,256,851 | 6/1966 | Ackerman | 440/75 |
| 3,376,842 | 4/1968 | Wynne | 440/75 |
| 3,931,783 | 1/1976 | Croisant | 440/88 |
| 4,421,497 | 12/1983 | Federmann et al. | 464/183 |
| 4,650,428 | 3/1987 | Bland et al. | 440/83 |
| 4,744,153 | 5/1988 | Brand | 33/517 |
| 4,792,315 | 12/1988 | Karrasch et al. | 440/83 |

*Primary Examiner*—Jesûs D. Sotelo

*Attorney, Agent, or Firm*—Michael, Best & Friedrich

[57] ABSTRACT

An outboard motor comprising an engine, a propeller shaft, a first drive shaft portion defining an axis and having a first end connected to the engine, and a second end opposite the first end, a second drive shaft portion coaxially aligned with the first drive shaft portion, having a first end connected to the propeller shaft, and a second end opposite the first end of the second drive shaft portion and telescopically connected to the second end of the first drive shaft portion, a device for preventing relative rotation between the first and second drive shaft portions about the axis, and a device for securing the first drive shaft portion to the second drive shaft portion.

22 Claims, 2 Drawing Sheets

TWO PIECE DRIVE SHAFT RETENTION DEVICE FOR OUTBOARD MOTOR

BACKGROUND OF THE INVENTION

This invention relates generally to marine propulsion devices, such as outboard motors, and, more particularly, to a drive shaft assembly for use in such a marine propulsion device.

Drive shafts in conventional outboard motors are typically provided with one or more bearing races adjacent their lower ends and are exposed to corrosive water and exhaust gases at their upper ends. To provide improved lower end wear characteristics in conjunction with improved upper end corrosion resistance, prior drive shafts have been manufactured by friction welding a lower drive shaft member of carbon steel to an upper drive shaft member of stainless steel. However, friction welding is disadvantageous in that it requires costly secondary operations such as machining, heat treating and straightening. Further, if either of the upper or lower drive shaft require servicing, the entire drive shaft must be removed.

Attention is directed to the following U.S. Pat. Nos.:

| | | |
|---|---|---|
| Culver | 687,676 | November 26, 1901 |
| Peck | 1,843,089 | January 26, 1932 |
| Bossen | 2,384,436 | September 11, 1945 |
| Graue | 2,466,097 | April 5, 1949 |
| Kiekhaefer | 2,549,484 | April 17, 1951 |
| Green | 2,587,838 | March 4, 1952 |
| Hansson et al. | 3,006,311 | October 31, 1961 |
| Crum, Jr. | 3,069,875 | December 25, 1962 |
| Walden | 3,212,290 | October 19, 1965 |
| Ackerman | 3,256,851 | June 21, 1966 |
| Wynne | 3,376,842 | April 9, 1968 |
| Croisant | 3,931,783 | January 13, 1976 |
| Federmann et al. | 4,421,497 | December 20, 1983 |
| Karrasch et al. | 4,792,315 | December 20, 1988 |

SUMMARY OF THE INVENTION

The invention provides an outboard motor comprising an engine, a propeller shaft, a first drive shaft portion defining an axis and having a first end connected to the engine, and a second end opposite the first end, a second drive shaft portion coaxially aligned with the first drive shaft portion, having a first end connected to the propeller shaft, and a second end opposite the first end of the second drive shaft portion and telescopically connected to the second end of the first drive shaft portion, means for preventing relative rotation between the first and second drive shaft portions about the axis, and means for securing the first drive shaft portion to the second drive shaft portion.

In one aspect of the invention, a marine propulsion device is provided comprising an engine, a propeller shaft, an upper drive shaft portion extending along a generally vertical axis and having an upper end connected to the engine, and a lower end including a male spline, a lower drive shaft Portion coaxial with the upper drift shaft portion, having a lower end connected to the propeller shaft, and an upper end including a female spline receiving the male spline in direct driving engagement, and means for securing the upper drive shaft portion to the lower drive shaft portion against axial separation.

In another aspect of the invention, a marine propulsion device is provided comprising an engine, a lower unit including a propeller shaft, and a transmission in driving engagement with the propeller shaft and including a bevel gear, an upper drive shaft portion formed predominantly of stainless steel, extending along a generally vertical axis, having an upper end drivingly engaged by the engine, a lower male end opposite the upper end, an aperture extending transversely through the male end with respect to the generally vertical axis, a male spline formed between the upper end and the aperture, proximate the aperture, and a keyway formed between the upper end and the male spline proximate the male spline, a water pump drivingly engaged by the upper drive shaft at the keyway, a lower drive shaft portion in the lower unit, formed predominantly of carbon steel, extending coaxially with the generally vertical axis, having a lower end including a bevel gear drivingly engaged with the bevel gear of the transmission, an upper end including a female socket having an open end telescopically receiving the male end, having a closed end opposite the open end, and a female spline proximate the open end and in direct driving engagement with the male spline, coarse threads between the upper and lower ends of the lower drive shaft portion, and an aperture extending through the upper end of the lower drive shaft portion between the open end and the closed end of the female socket and in axial alignment with the aperture through the upper drive shaft portion, a spring in the female socket biasing the male end from the closed end, and a pin passing through the aperture in the male end and the aperture in the upper end of the lower drive shaft, the pin thereby substantially preventing axial separation of the male end from the closed end.

In another aspect of the invention, a marine propulsion device is provided comprising an engine, a propeller shaft, a first drive shaft portion defining an axis and having a first end connected to the engine, and a second end opposite the first end, a second drive shaft portion axially aligned with the first drive shaft portion, having a first end communicating with the propeller shaft, and a second end opposite the first end of the second drive shaft portion, one of the second end of the first drive shaft portion and the second end of the second drive shaft portion defining a male end including a flange, the other of the second end of the first drive shaft portion and the second end of the second drive shaft portion including a female socket extending in the direction of the axis, retaining means slideably housed in the female socket and telescopically receiving the male end, and non-releasably engaging the flange, and selectable means for fixing the axial position of the retaining means in the female socket.

In another aspect of the invention, an apparatus is provided comprising an elongated shaft defining an axis and including a male end comprising a flange, an opposite second end, and a male spline between the flange and the second end, proximate the flange, a second shaft including an end defining a female socket including an open end telescopically receiving the male end, the female socket including a female spline proximate the open end in direct driving engagement with the male spline for common rotation about the axis, and an aperture extending through the female socket in transverse relation to the axis and spaced from the open end, and a retainer having the general shape of a hollow cylinder being slideably movable in the female socket along the axis, telescopically receiving the male end, and including an aperture in alignment with the aperture through the female socket, and a radially inwardly extending projection non-releasably engaging the flange.

A further aspect of the invention provides a method of assembling a marine propulsion device including an elongated drive shaft defining an axis and including a male end including a flange, an opposite second end, and a male spline between the flange and the second end proximate the flange, a second drive shaft including an end defining a female socket including an open end for telescopic receipt of the male end, the female socket including a female spline proximate the open end and for direct driving engagement with the male spline for common rotation about the axis, and an aperture extending through the female socket in transverse relation to the axis and spaced from the open end, and a retainer having the general shape of a hollow cylinder for close sliding movement in the female socket along the axis and for telescopic receipt of the male end and having a transversely extending aperture for alignment with the aperture through the female socket when the retainer is mounted in the socket and is sufficiently spaced from the open end, along the axis, that the male spline can engage the female spline, a radially inwardly extending projection for nonreleasably engaging the flange, and a pin for connecting the retainer to the socket by simultaneously passing through the aperture through the female socket and the aperture through the retainer, the method comprising the steps of telescopically sliding the retainer into the female socket, passing the Pin through both the aperture through the retainer and the aperture through the female socket after the step of telescopically sliding the retainer into the female socket, and telescopically inserting the male end into the retainer until the flange is nonreleasably engaged by the projection.

Various other principal features of the invention will become apparent to those skilled in the art upon review of the following detailed description, claims, and drawings.

Figure 1:
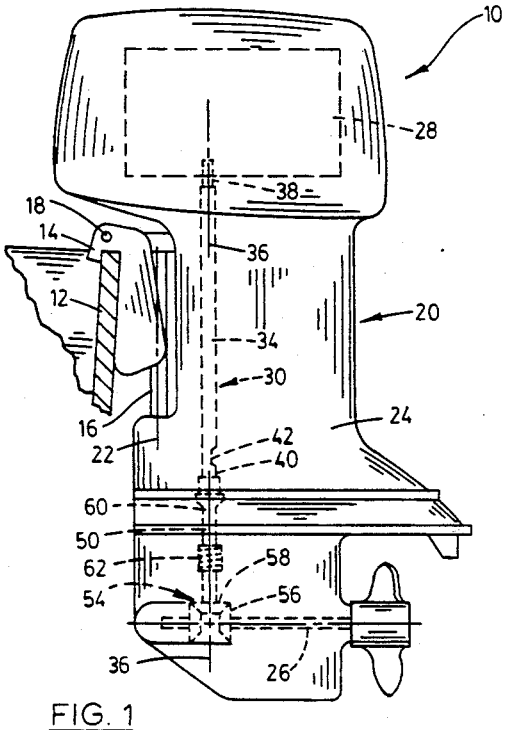
FIG. 1 is a side elevational view of a marine propulsion device which includes a drive shaft assembly and which embodies various of the features of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Shown in FIG. 1 is a marine propulsion device 10 embodying the invention. Although the invention is illustrated and described herein in conjunction with an outboard motor, the invention can be used in conjunction with stern drives and other types of marine propulsion devices. As best shown in FIG. 1, the marine propulsion device 10 comprises a mounting assembly fixedly attached to the transom 12 of a boat. While various suitable mounting assemblies can be employed, in the preferred embodiment, the mounting assembly includes a transom bracket 14 fixedly attached to the transom 12, and a swivel bracket 16 mounted on the transom bracket 14 for pivotal movement of the swivel bracket 16 relative to the transom bracket 14 about a generally horizontal tilt axis 18.

The marine propulsion device 10 further comprises a propulsion unit 20 mounted on the swivel bracket 16 for pivotal movement of the propulsion unit 20 relative to the swivel bracket 16 about a generally vertical steering axis 22. The propulsion unit 20 includes a lower unit 24 having a rotatably mounted propeller shaft 26, and further includes an internal combustion engine 28 mounted on the lower unit 24. The marine propulsion device 10 further includes a drive shaft assembly 30 drivingly connecting the engine 28 to the propeller shaft 26.

The drive shaft assembly 30 is rotatably mounted in the propulsion unit 20.

The drive shaft assembly 30 includes a first or upper drive shaft portion 34 defining an axis 36 and having a first or upper end 38 connected to and drivingly engaged by the engine 28. While various other configurations could be employed, in the illustrated embodiments, the axis 36 extends in a generally vertical direction. Further, while various other materials could be employed, in the illustrated embodiments, the first or upper drive shaft portion is formed predominantly of a first metal which, more particularly, is a corrosion resistant metal, and still more particularly, comprises stainless steel. The first drive shaft portion 34 further includes a second or lower end 40 opposite the first end 38, and a keyway 42 formed between the first end 38 and the second end 40, proximate the second end 40, for a purpose that will later be described.

The drive shaft assembly 30 further includes a second or lower drive shaft portion 50 aligned with the first drive shaft portion 34 along the axis 36 and having a first or lower end 52 connected to the propeller shaft 26. More particularly, the lower unit 24 includes a transmission 54 in driving engagement with the propeller shaft 20 and including a bevel gear 56, and the first end 42 of the second drive shaft portion 50 includes a bevel gear 58 drivingly engaged by the bevel gear 56 of the transmission 54. Further, while various other materials could be employed, in the illustrated embodiments, the second drive shaft portion 50 is formed predominantly of a second metal which is different from the first metal of which the first drive shaft portion 34 is comprised. More particularly, the second metal is a wear resistant metal, and still more particularly, comprises carbon steel. The second drive shaft portion 50 further includes a second or upper end 60 opposite the first end 52, and telescopically connected to the second end 40 of the first drive shaft portion 34. The second drive shaft portion 50 further includes a coarsely threaded region 62 between the first end 52 and the second end 60 for a purpose that will later be described.

The marine propulsion device 10 further includes means for preventing relative rotation between the first and second drive shaft portions, 34 and 50, respectively. While various other means could be employed, in the illustrated embodiments, the rotation prevention means comprises a male spline 64 on one of the second end 40 of the first drive shaft portion 34 and the second end 60 of the second drive shaft portion 50, and a female spline 66 on the other of the second end 40 and the second end 60 and receiving the male spline 64 in direct driving engagement in alignment with the axis 36.

The marine propulsion device 10 further includes means for securing the first drive shaft portion 34 to the second drive shaft portion 50 against separation in the direction of the axis 36.

Figure 4:
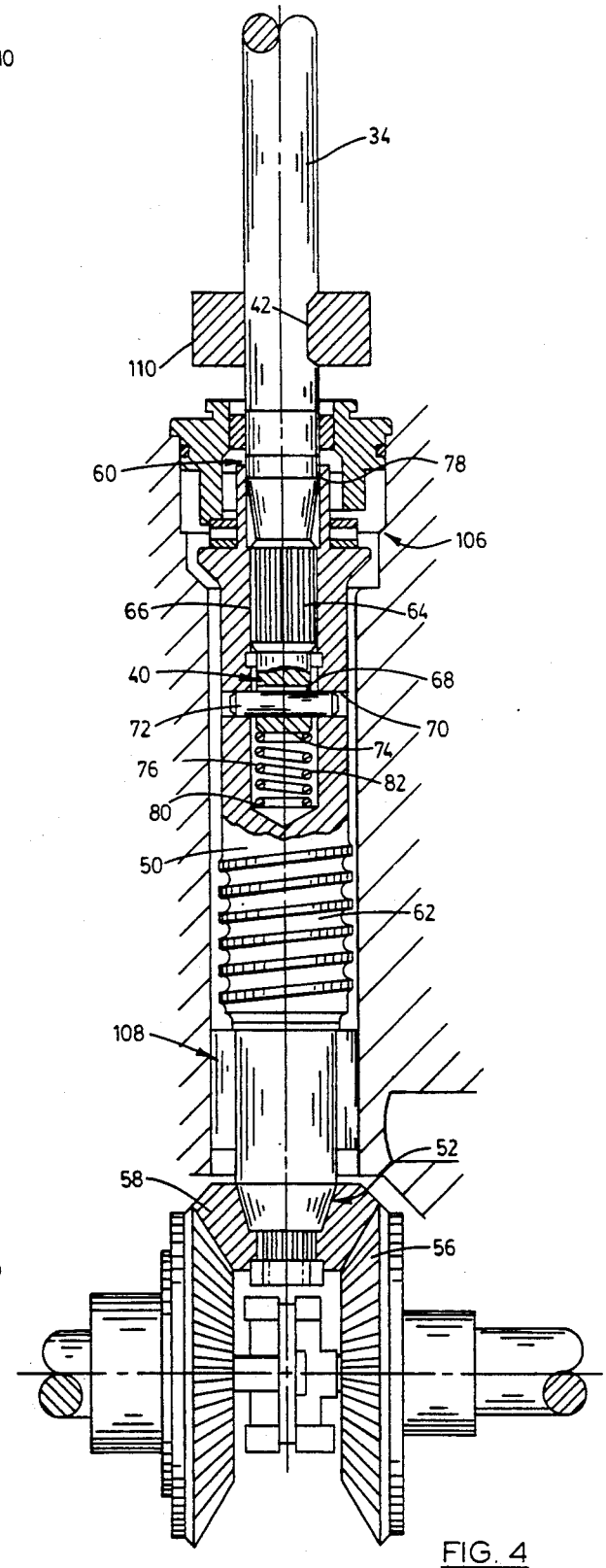
FIG. 4 is a fragmentary side elevational view of the marine propulsion device illustrated in FIG. 1 showing the drive shaft assembly of FIG. 2 assembled within the lower unit of the marine propulsion device.
Figure 2:
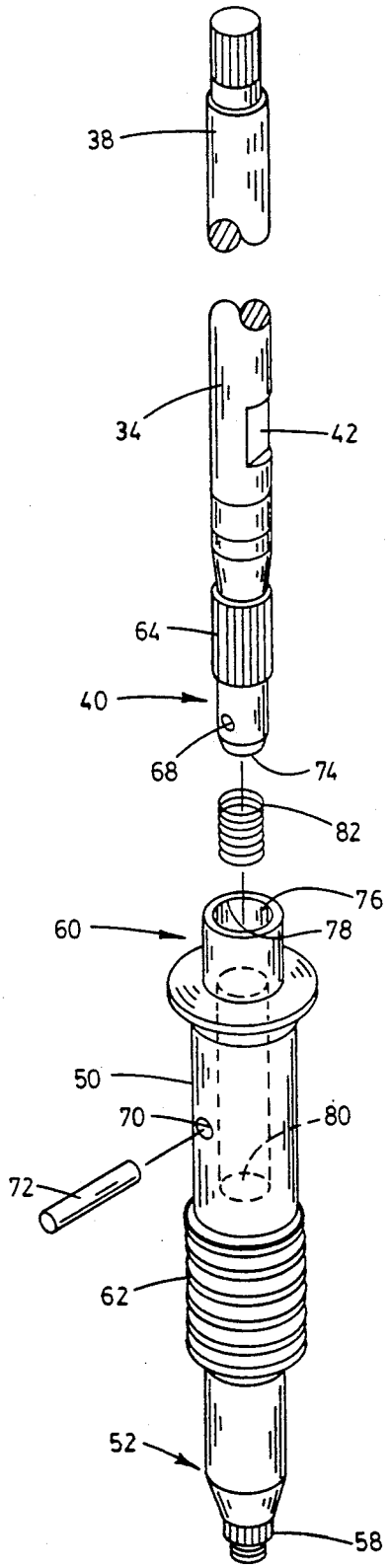
FIG. 2 is an exploded perspective view of one embodiment of the drive shaft assembly used in the marine propulsion device shown in FIG. 1.

While various other means could be employed, in the first embodiment of the invention, illustrated in FIGS. 2 and 4, the securing means comprises an aperture 68 extending through the second end 40 of the first drive shaft portion 34 in transverse relation to the axis 36, an aperture 70 extending through the second end 60 of the second drive shaft portion 50, and a pin 72 passing through both the aperture 70 in the second end 60 of the second drive shaft portion 50, and through the aperture 60 in the second end 40 of the first drive shaft portion 34. More particularly, in the first illustrated embodiment of the invention, one of the second end 40 of the first drive shaft portion 34 and the second end 60 of the second drive shaft portion 50 includes a male end 74, and the other of the second end 40 of the first drive shaft portion 34 and the second end 60 of the second drive shaft Portion 50 includes a female socket 76 having an open end 78 telescopically receiving the male end 74 and having a closed end 80 opposite the open end 78

The marine propulsion device 10, in the first illustrated embodiment of the invention, further includes means for biasing the male end 74 from the closed end 80, the pin 72 preventing axial separation of the male end 74 from the closed end 80 against the force of the spring 82. While various other means could be employed, in the illustrated embodiment, the biasing means comprises a spring 82 in the female socket 76 and biasing the male end 74 from the closed end 80. Still more particularly, in the first illustrated embodiment of the invention, the second end 40 of the first drive shaft portion 34 includes the male end 74 and the male spline 64, and the second end 60 of the second drive shaft portion 50 includes the female socket 76 and the female spline 66.

In the first illustrated embodiment, the aperture 70 through the female socket 76 has a diameter which allows a close fit with the pin 72. On the other hand, the aperture 68 through the male end 74 has a diameter which is greater than the diameter of the pin 72 and the diameter of the aperture 70. This allows for ease of alignment of the aperture 68 with the aperture 70 in view of the need to align the male spline 64 with the female spline 66. Further, the spring 82 is sufficiently strong, for example 50 lbs., to make the drive shaft assembly 30 substantially rigid, regardless of the aperture 68 having a greater diameter than the diameter of the pin 72 and the diameter of the aperture 70, that the marine propulsion device 10 can be assembled as if the drive shaft assembly 30 were a single piece (prior art) drive shaft.

Figure 5:
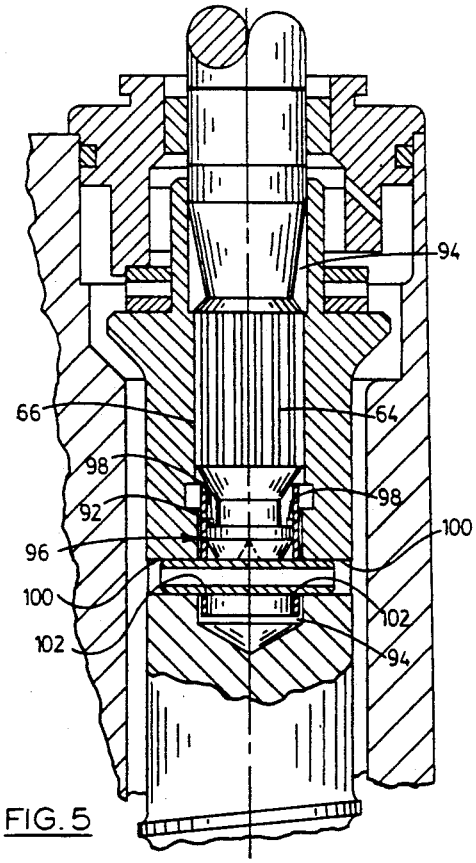
FIG. 5 is an enlarged fragmentary view, similar to FIG. 4, showing the drive shaft assembly of FIG. 3 assembled within the lower unit of the marine propulsion device.
Figure 3:
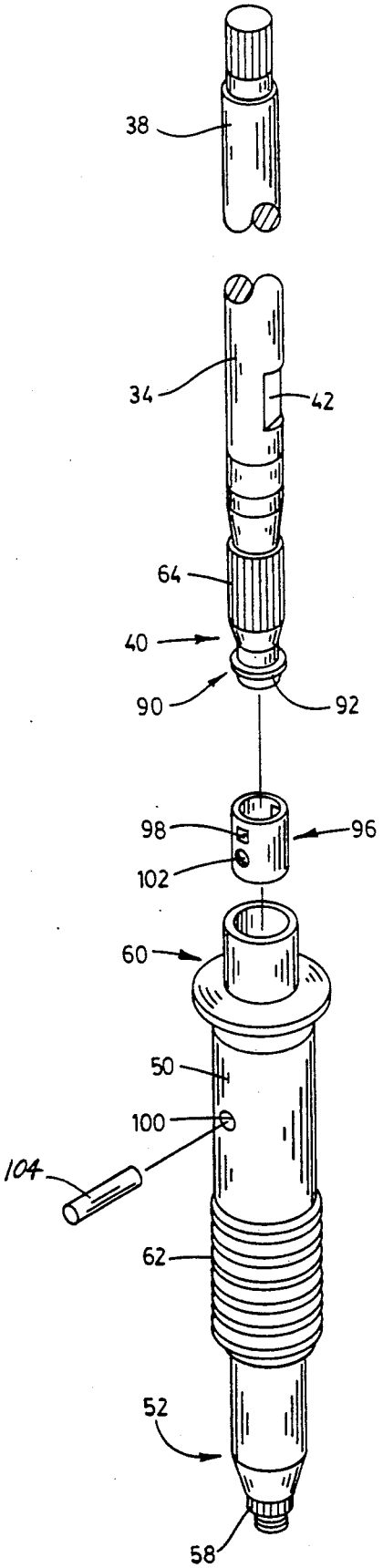
FIG. 3 is an exploded perspective view of another embodiment of a drive shaft assembly used in the marine propulsion device of FIG. 1.

In the second embodiment of the invention, illustrated in FIGS. 3 and 5, the securing means comprises a male end 90 which includes a flange 92 and which is on one of the second end 40 of the first drive shaft portion 34 and the second end 60 of the second drive shaft portion 50, a female socket 94 included in the other of the second end 40 of the first drive shaft portion 34 and the second end 60 of the second drive shaft portion 50 and extending in the direction of the axis 36, retaining means slideably housed in the female socket 94 and telescopically receiving the male end 90, and selectable means for fixing the position of the retaining means in the female socket 94 with respect to movement in the direction of the axis 36.

While various other configurations could be employed, in the second embodiment of the invention, illustrated in FIGS. 3 and 5, the female socket 94 comprises the general shape of a hollow cylinder, and the retaining means comprises a retainer 96 having the general shape of a hollow cylinder, adapted for close sliding movement in the female socket 94 along the axis 36, and including a radially inwardly extending resilient projection 98 non-releaseably engaging the flange 92. In the illustrated embodiment, the retainer 96 includes two or more angularly spaced projections 98 non-releasably engaging the flange 92.

While various other fixing means could be employed, in the second embodiment of the invention, illustrated in FIGS. 3 and 5, the fixing means comprises an aperture 100 extending generally transversely through the female socket 94, with respect to the axis 36, an aperture 102 extending generally transversely through the retainer 96 for alignment with the aperture 100 extending through the female socket 94 when the retainer 96 is in the socket 94 and is sufficiently spaced from the open end 78, along the axis 36, that the male spline 64 can engage the female spline 66, and a pin 104 for connecting the retainer 96 to the female socket 94 by passing through both the aperture 100 in the female socket 94 and the aperture 102 in the retainer 96.

More particularly, in the second illustrated embodiment of the invention, the second end 40 of the first drive shaft portion 34 includes the male end 90 and the male spline 64, and the second end 60 of the second drive shaft portion 50 includes the female socket 94 and the female spline 66. Still more particularly, in the embodiment illustrated in FIG. 5, the female spline 66 extends along the axis 36, toward the first end 52, by a predetermined distance so that travel of the male spline 64 toward the first end 52 is limited by the female spline 66 at a location where the projection 98 is capable of engaging the flange 92.

In assembling the embodiment of the marine propulsion device 10 illustrated in FIGS. 3 and 5, the retainer 96 is telescopically slid into the female socket 94, the pin 104 is passed through both the aperture 100 and the aperture 102 after the retainer 96 is telescopically slid into the female socket 94, and the male end 90 is telescopically inserted into the retainer 96 until the flange 92 is non-releaseably engaged by the resilient projection 98. This method produces the configuration illustrated in FIG. 5.

Shown in FIG. 4 is the drive shaft assembly 30 mounted within the lower unit 24 of the marine propulsion device 10. While the drive shaft assembly shown in FIG. 4 embodies the first embodiment of the invention, described in conjunction with FIG. 2, it is to be understood that the drive shaft assembly embodying the second embodiment of the invention, described in conjunction with FIG. 3 is mounted on the lower unit 24 in a substantially identical manner illustrated in fragmentary form in FIG. 5.

As shown in FIG. 4, the second drive shaft portion 50 is mounted for rotation within the lower unit 24 by means of a pair of bearing assemblies 106 and 108 engaging the second drive shaft portion 50 adjacent the second end 60 and first end 50 respectively. Because the bearing assemblies 106 and 108 each bear against the second drive shaft portion 50, the second drive shaft portion 50 is preferably formed of wear resistant carbon steel which exhibits good bearing surface characteristics.

As further illustrated in FIG. 4, the marine propulsion device 10 further includes a schematically illustrated water pump 110 which is preferably an impeller type water pump, which is drivingly coupled to the drive shaft assembly 30 at the keyway 42 of the first drive shaft portion 34, adjacent the second end 40 of the first drive shaft Portion 34, and which functions to circulate cooling water through the marine propulsion device 10 upon rotation of the drive shaft assembly 30.

Because, in most outboard motors, the portion of the drive shaft assembly 30 represented by the first drive shaft portion 34 is at least partially exposed to potentially corrosive cooling water and to highly corrosive exhaust gases developed by the internal combustion engine 28, the first drive shaft portion 34 is preferably formed of corrosion resistant stainless steel. The first drive shaft portion is drivingly connected at its upper end through a coupling with the engine 28 and thus the first drive shaft portion 34 is freely supported between the internal combustion engine 28 and the second end 60 of the second drive shaft portion 50. Therefore, no additional support bearings are required and the wear and bearing surface properties of the first drive shaft portion 34 are of lesser concern than are corrosion resistant properties.

As further illustrated in FIG. 4, the coarse threads 62 act in cooperation with the lower unit 24 to define an Archimedes screw for helping to flow lubricant into the upper bearing assembly 106 during operation of the marine propulsion device 10.

Various other details of the illustrated construction are set forth in U.S. Karrasch et al. Pat. No. 4,792,315, the specification of which is incorporated herein by reference.

Various features of the invention are set forth in the following claims.

We claim:

1. An outboard motor comprising an engine, a propeller shaft, a first drive shaft portion defining an axis and having a first end connected to said engine, and a second end opposite said first end, a second drive shaft portion coaxially aligned with said first drive shaft portion, and having a first end connected to said propeller shaft, and a second end opposite said first end of said second drive shaft portion, one of said second end of said first drive shaft portion and said second end of said second drive shaft portion including a splined male end, the other of said second end of said first drive shaft portion and said second end of said second drive shaft portion including a splined female socket having an open end telescopically receiving said splined male end to prevent relative rotation therebetween about the axis, and having a closed end opposite said open end, an aperture extending through said second end of said first drive shaft portion in transverse relation to the axis defined by said first drive shaft portion, an aperture extending through said second end of said second drive shaft portion in alignment with the aperture through said second end of said first drive shaft portion, means for biasing said male end away from said closed end, and a pin passing through said aperture in said second end of said second drive shaft portion and through said aperture in said second end of said first drive shaft portion, said pin preventing axial separation of said male end from said closed end against the force of said biasing means.

2. An outboard motor in accordance with claim 1 wherein said biasing means comprises a spring in said female socket and biasing said male end from said closed end.

3. An outboard motor in accordance with claim 1 and further including a transmission in driving engagement with said propeller shaft and including a bevel gear, and wherein said first end of said second drive shaft portion includes a bevel gear drivingly engaged with said bevel gear of said transmission.

4. An outboard motor comprising an engine, a propeller shaft, a first drive shaft portion defining an axis and having a first end connected to said engine, and a second end opposite said first end, a second drive shaft portion coaxially aligned with said first drive shaft portion, and having a first end connected to said propeller shaft, and a second end opposite said first end of said second drive shaft portion, one of said second end of said first drive shaft portion and said second end of said second drive shaft portion defining a male end, the other of said second end of said first drive shaft portion and said second end of said second drive shaft portion defining a female socket having an open end telescopically receiving said male end, means for preventing relative rotation between said first and second drive shaft portions about the axis, an aperture extending through said second end of said first drive shaft portion in transverse relation to the axis defined by said first drive shaft portion, an aperture extending through said second end of said second drive shaft portion in alignment with the aperture through said second end of said first drive shaft portion, a pin passing through said aperture in said second end of said second drive shaft portion and through said aperture in said second end of said first drive shaft portion to prevent axial separation between said drive shaft portions, and a spring located in said female socket and bearing against said second end of said first drive shaft portion.

5. An outboard motor in accordance with claim 4 wherein said first drive shaft portion and said second drive shaft portion define a drive shaft assembly, wherein said pin has a diameter, wherein one of said apertures comprises a slot having an axial length substantially greater than said pin diameter, and wherein said spring provides sufficient force such that said drive shaft assembly is substantially axially rigid regardless of the substantially greater axial length of said slot as compared to the diameter of said aperture through said male end.

6. An outboard motor comprising an engine, a propeller shaft, a first drive shaft portion defining an axis and having a first end connected to said engine, and a second end opposite said first end, said first drive shaft portion being formed predominantly of a first metal, a second drive shaft portion coaxially aligned with said first drive shaft portion, having a first end connected to said propeller shaft, and a second end opposite said first end of said second drive shaft portion and telescopically connected to said second end of said first drive shaft portion, said second drive shaft portion being formed predominantly of a second metal which is different from said first metal, means for preventing relative rotation in both directions between said first and second drive shaft portions about the axis, and means for securing together said first drive shaft portion and said second drive shaft portion.

7. An outboard motor in accordance with claim 6 wherein said first metal comprises a corrosion resistant metal and said second metal comprises a wear resistant metal.

8. An outboard motor in accordance with claim 6 wherein said first metal comprises stainless steel and said second metal comprises carbon steel.

9. A marine propulsion device comprising an engine, a lower unit including a propeller shaft, and a transmission in driving engagement with said propeller shaft and including a bevel gear, an upper drive shaft portion formed Predominantly of stainless steel, extending along a generally vertical axis, having an upper end drivingly engaged by said engine, a lower male end opposite said upper end, an aperture extending transversely through said male end with respect to the generally vertical axis, a male spline formed between said upper end and said aperture, proximate said aperture, and a keyway formed between said upper end and said male spline proximate said male spline, a water pump drivingly engaged by said upper drive shaft portion at said keyway, a lower drive shaft portion in said lower unit, formed predominantly of carbon steel, extending coaxially with the generally vertical axis, having a lower end including a bevel gear drivingly engaged with said bevel gear of said transmission, an upper end including a female socket having an open end telescopically receiving said male end, having a closed end opposite said open end, and a female spline proximate said open end and in direct driving engagement with said male spline, coarse threads between said upper and lower ends of said lower drive shaft portion, and an aperture extending through said upper end of said lower drive shaft portion between said open end and said closed end of said female socket and in axial alignment with said aperture through said upper drive shaft portion, a spring in said female socket biasing said male end from said closed end, and a pin passing through said aperture in said male end and said aperture in said upper end of said lower drive shaft portion, said pin thereby substantially preventing axial separation of said male end from said closed end.

10. A marine propulsion device comprising an engine, a propeller shaft, a first drive shaft portion defining an axis and having a first end connected to said engine, and a second end opposite said first end, a second drive shaft portion axially aligned with said first drive shaft Portion, having a first end communicating with said propeller shaft, and a second end opposite said first end of said second drive shaft portion, one of said second end of said first drive shaft portion and said second end of said second drive shaft portion defining a male end including a flange, the other of said second end of said first drive shaft portion and said second end of said second drive shaft portion including a female socket extending in the direction of the axis, retaining means slideably housed in said female socket and telescopically receiving said male end, and non-releasably engaging said flange, and selectable means for fixing the axial position of said retaining means in said female socket.

11. A marine propulsion device in accordance with claim 10 wherein said female socket comprises the general shape of a hollow cylinder, and wherein said retaining means comprises a retainer, having the general shape of a hollow cylinder, adapted for close sliding movement in said female socket along the axis, and including a radially inwardly extending projection non-releasably engaging said flange.

12. A marine propulsion device in accordance with claim 11 wherein said fixing means comprises an aperture extending generally transversely through said female socket, with respect to the axis, an aperture passing generally transversely through said retainer in alignment with said aperture through said female socket, and a pin selectively insertable into the aperture in said female socket.

13. A marine propulsion device in accordance with claim 10 and further including a transmission in driving engagement with said propeller shaft, and including a bevel gear, and wherein said first mentioned end of said second drive shaft portion includes a bevel gear in driving engagement with said gear of said transmission.

14. A marine propulsion device in accordance with claim 10 wherein said first drive shaft portion is formed predominantly of a first metal, and wherein said second drive shaft portion is formed predominantly of a second metal which is different from said first metal

15. A marine propulsion device in accordance with claim 14 wherein said first metal comprises a corrosion resistant metal and said second metal comprises a wear resistant metal.

16. A marine propulsion device in accordance with claim 14 wherein said first metal comprises stainless steel and said second metal comprises carbon steel.

17. A marine propulsion device in accordance with claim 10 and further including a lower unit housing said second drive shaft portion, and coarse threads between said first end and said second end of said second drive shaft portion, and cooperating with said lower unit to define an Archimedes screw.

18. A marine propulsion device in accordance with claim 10 and further including a water pump, and a keyway formed between said first end and said second end of said first drive shaft portion, said keyway drivingly engaging said water pump.

19. An apparatus comprising an elongated shaft defining an axis and including a male end comprising a flange, an opposite second end, and a male spline between said flange and said second end, proximate said flange, a second shaft including an end defining a female socket including an open end telescopically receiving said male end, said female socket including a female spline proximate said open end in direct driving engagement with said male spline for common rotation about the axis, and an aperture extending through said female socket in transverse relation to the axis and spaced from said open end, and a retainer having the general shape of a hollow cylinder being slideably movable in said female socket along the axis, telescopically receiving said male end, and including an aperture in alignment with said aperture through said female socket, and a radially inwardly extending projection non-releasably engaging said flange.

20. An apparatus in accordance with claim 19 wherein said first mentioned shaft is formed Predominantly of a first metal, and wherein said second shaft is formed predominantly of a second metal which is different from said first metal.

21. An apparatus in accordance with claim 20 wherein one of said first metal and said second metal comprises stainless steel and the other of said first metal and said second metal comprises carbon steel.

22. A method of assembling a marine propulsion device including an elongated drive shaft defining an axis and including a male end including a flange, an opposite second end, and a male spline between the flange and the second end proximate the flange, a second drive shaft including an end defining a female socket including an open end for telescopic receipt of the male end, the female socket including a female spline proximate the open end and for direct driving engagement with the male spline for common rotation about the axis, and an aperture extending through the female socket in transverse relation to the axis and spaced from the open end, and a retainer having the general shape of a hollow cylinder for close sliding movement in the female socket along the axis and for telescopic receipt of the male end and having a transversely extending aperture for alignment with the aperture through the female socket when the retainer is mounted in the socket and is sufficiently spaced from the open end, along the axis, that the male spline can engage the female spline, a radially inwardly extending projection for nonreleasably engaging the flange, and a pin for connecting the retainer to the socket by passing through both the aperture through the female socket and the aperture through the retainer, said method comprising the steps of telescopically sliding the retainer into the female socket, passing the pin through both the aperture through the retainer and the aperture through the female socket after said step of telescopically sliding the retainer into the female socket, and telescopically inserting the male end into the retainer until the flange is nonreleasably engaged by the projection.

* * * * *